US008745779B2

(12) United States Patent
Roberg

(10) Patent No.: US 8,745,779 B2
(45) Date of Patent: Jun. 10, 2014

(54) R BED ROLL IN-BED PATIENT-POSITIONING AND MANIPULATION SYSTEMS

(76) Inventor: Annette Roberg, Chattaroy, WA (US)

( * ) Notice: Subject to any disclaimer, the term of this patent is extended or adjusted under 35 U.S.C. 154(b) by 0 days.

(21) Appl. No.: 13/285,520

(22) Filed: Oct. 31, 2011

(65) Prior Publication Data

US 2012/0144581 A1 Jun. 14, 2012

Related U.S. Application Data

(60) Provisional application No. 61/422,360, filed on Dec. 13, 2010.

(51) Int. Cl.
*A61G 7/10* (2006.01)

(52) U.S. Cl.
USPC ..... 5/81.1 C; 5/81.1 RP

(58) Field of Classification Search
USPC ..... 5/81.1 R, 81.1 C, 81.1 RP, 81.1 HS
See application file for complete search history.

(56) References Cited

U.S. PATENT DOCUMENTS 3,765,037 A * 10/1973 Dunkin ..... 5/81.1 C
4,794,655 A * 1/1989 Ooka et al. ..... 5/81.1 C
4,797,960 A 1/1989 Vaiana et al.
4,941,220 A * 7/1990 DiMatteo et al. ..... 5/81.1 C
5,390,379 A 2/1995 Palmer, Jr. et al.
5,469,588 A 11/1995 DiMatteo et al.
5,608,929 A 3/1997 Crane
5,901,388 A 5/1999 Cowan
6,629,323 B2 10/2003 Sverdlik et al.
7,111,338 B2 9/2006 Faux et al.
7,293,303 B2 11/2007 Worrell

* cited by examiner

*Primary Examiner* — Fredrick Conley
(74) *Attorney, Agent, or Firm* — RG Patent Consulting, LLC; Rachel Gilboy

(57) ABSTRACT

An in-bed patient-positioning and manipulation system for moving patients within their bed. The in-bed patient-positioning and manipulation system comprises: a conveyor sheet; at least one housing unit having, a roller located therein comprising a shaft; at least one gearing cluster; a power source; and a remote. The conveyor sheet is connected to the roller(s) with the roller(s) being housed within inner volume(s) of the housing unit. The two housing units are mounted under each end of a hospital (or other) bed. There is one long sheet, which is rolled and sequentially stored in the housing units and along the upper surface of the bed. The sheet will retract back once the control on the included remote is pressed. Further, the conveyor sheet is able to be rolled and unrolled to manipulate a relative position of a patient residing in the bed.

20 Claims, 5 Drawing Sheets

R BED ROLL IN-BED PATIENT-POSITIONING AND MANIPULATION SYSTEMS

CROSS-REFERENCE TO RELATED APPLICATION

The present application is related to and claims priority from prior provisional application Ser. No. 61/422,360, filed Dec. 13, 2010 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of bed accessories and more specifically relates to in-bed patient-positioning and manipulation systems.

2. Description of the Related Art

Many individuals in modern society sleep in beds. Residences and other facilities may provide beds for individuals who reside therein to use for resting and sleeping periods. Patients who are disabled or bedridden often have difficulty positioning themselves in beds. When for example hospital beds are in the upright position (back is upright in relation to the rest of the bed), patients have a tendency to slide downwards with the sheets. Many are unable to pull themselves back up without assistance. This may lead to an uncomfortable positioning for the patient. Patients are typically frustrated by this process and resort to contacting medical staff to help them get to a more comfortable position.

Medical staff often assist patients in various tasks. Moving a patient repeatedly can be a painful and difficult process for the staff member and for the patient. The repeated lifting of patients in awkward positioning may lead to back strain and injuries to the staff and/or patients. Further, the time and effort consumed by the process is not cost-effective for the health industry. The present methods and means are not effective.

Various attempts have been made to solve the above-mentioned problems such as those found in U.S. Pat. Nos. 5,469,588; 4,797,960; 5,390,379; 5,608,929; 5,901,388; 7,293,303; 7,111,338; and 6,629,323. This art is representative of bed accessories. None of the above inventions and patents, taken either singly or in combination, is seen to describe the invention as claimed.

Ideally, a patient maneuvering means for use with a bed should be user-friendly and, yet would operate reliably and be manufactured at a modest expense. Thus, a need exists for a reliable in-bed patient-positioning and manipulation system to maneuver patients to desired position(s) and to avoid the above-mentioned problems.

BRIEF SUMMARY OF THE INVENTION

In view of the foregoing disadvantages inherent in the known bed accessory art, the present invention provides a novel in-bed patient-positioning and manipulation system. The general purpose of the present invention, which will be described subsequently in greater detail is to provide safety and convenience for moving patients relative positioning within their bed.

The present invention, in-bed patient-positioning and manipulation system, as disclosed herein, preferably comprises: a conveyor sheet; at least one housing unit having, inner volume(s); at least one roller comprising a shaft; at least one gearing cluster including at least one drive gear and at least one driven gear, wherein the drive gear comprises a greater number of teeth than the driven gear; bearings; a power source; and a remote. The bed may comprise a hospital-bed or the present invention may be used with other beds.

The conveyor sheet may be connected to the roller(s) with the roller(s) being housed within the inner volume(s) of the housing unit. The conveyor sheet preferably comprises a water-resistant fabric such that is easy to clean. Further, the conveyor sheet is able to be rolled and unrolled to manipulate a relative position of a patient residing in the bed. The gearing cluster comprises a low speed gear ratio such that the conveyor sheet moves in a small incremental rotation with low speed gear ratio comprises at least a 10 to 1 ratio. The driven gear is preferably located on (or adjacent) the shaft. The gearing cluster(s) (or other suitable equivalent) are connected to the roller(s) such that the roller(s) may be rotatably-drive-manipulated via the remote, when the remote is activated to sequentially roll the conveyor sheet upon the roller(s). Additionally the remote is powered via the power source. The remote comprises a rotation speed-controller (acting in the capacity of a rheostat) along with up and down control-buttons and other buttons for controlling other features/options. In certain embodiments the controlling means may be using other OEM remotes such as those that may be already available for bed positioning or the like.

The housing units are preferably mounted under each end of a bed so they do not obstruct regular operations of the bed, and further do not effect hospital staff and patient movements. The housing unit(s) comprise a cylindrical member(s) with the cylindrical member(s) comprising an upper-opening such that the conveyor sheet is able to ingress and egress and be rolled about a shaft. The device is oriented lengthwise-parallel with the bed.

A kit is described herein comprising an in-bed patient-positioning manipulation assembly including a conveyor sheet; two housing units; and a remote.

In accordance with the embodiments of the present invention a preferred method of use is disclosed herein comprising the steps of: installing an in-bed patient-positioning manipulation assembly onto a bed; activating a remote to incrementally move a conveyor sheet in relation to an upper surface of the bed to move a patient positioned on the conveyor sheet; and manipulating a rotation speed of the conveyor sheet with the conveyor sheet being coupled to a roller via a rotation speed-controller. The conveyor sheet can be rolled upwardly causing the patient to be pulled towards the head of the bed. The conveyor sheet may also be unrolled (from the roller located nearest the head of the bed to the roller located proximate the foot of the bed) causing the patient to be pulled towards the foot of the bed.

The present invention holds significant improvements and serves as an in-bed patient-positioning and manipulation system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, in-bed patient-positioning and manipulation system entitled "R Bed Roll", constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a bed accessory device and more particularly to an in-bed patient-positioning and manipulation system as used to improve the convenience and safety of moving patient's relative positioning within a bed.

Figure 1:
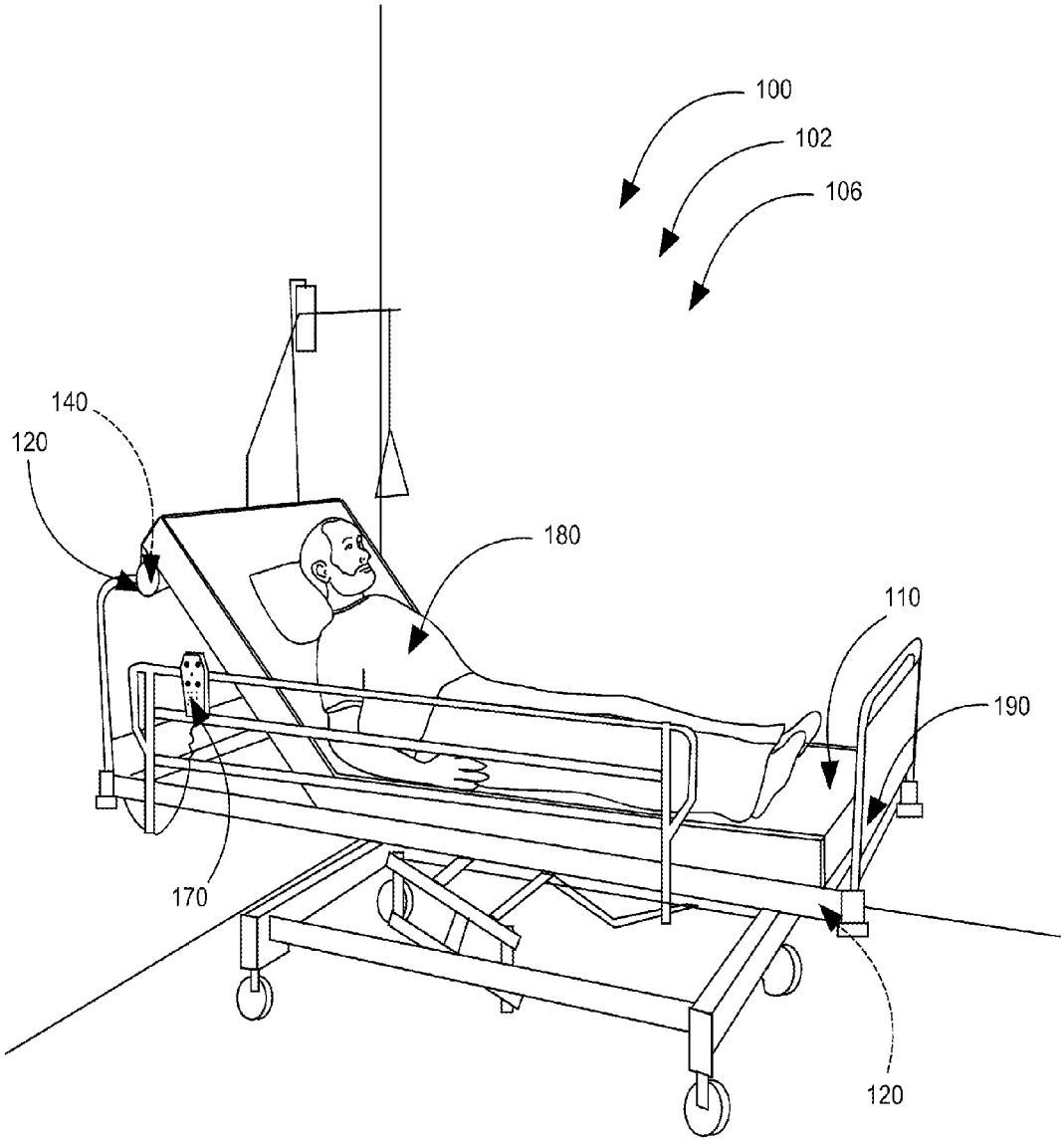
FIG. 1 shows a perspective view illustrating an in-bed patient-positioning and manipulation system in an in-use condition according to an embodiment of the present invention.

Referring to the drawings by numerals of reference there is shown in FIG. 1, a perspective view illustrating in-bed patient-positioning and manipulation system 100 in in-use condition 106 according to an embodiment of the present invention.

In-bed patient-positioning and manipulation system 100 preferably eliminates the need for patient 180 to call for assistance and also prevents patient 180 from becoming injured while attempting to pull themselves upwardly or downwardly in relation to bed 190. In-bed patient-positioning and manipulation system 100 preferably works in conjunction with bed 190 found in a hospital (electrically-controlled in most embodiments). Upon reading this specification, it should be appreciated that, under appropriate circumstances, considering such issues as user preferences, design preference, structural requirements, marketing preferences, cost, available materials, technological advances, etc., other beds such as, for example, a standard bed, other versions of tilting beds such as sleep number beds, etc., may be used.

In-bed patient-positioning and manipulation system 100 within preferred embodiments preferably comprises: conveyor sheet 110; at least one housing unit 120 (preferably two) having, inner volume(s) 130; (each having) at least one roller 140; at least one gearing cluster 150; power source 160; and remote 170. Conveyor sheet 110 is preferably connected to roller(s) 140. Roller(s) 140 are preferably housed within inner volume(s) 130. Gearing cluster(s) 150 are preferably connected to roller(s) 140 such that roller(s) 140 may be rotatably-drive-manipulated via remote 170, when remote 170 is activated to sequentially roll conveyor sheet 110 upon roller(s) 140. Remote 170 may be powered via power source 160 as shown best in FIGS. 2 and 3. Conveyor sheet 110 is able to be rolled and unrolled to manipulate a relative position of patient 180 residing in bed 190 as shown in 'in-use' condition 106. Conveyor sheet 110 preferably comprises a water-resistant fabric, however other materials may be used. Water-resistant fabric is preferred since it is easy to clean and is durable in-use despite urine and other contaminates coming into contact with it on occasion. Housing units are preferably mounted under each end of hospital-bed 190.

Figure 2:
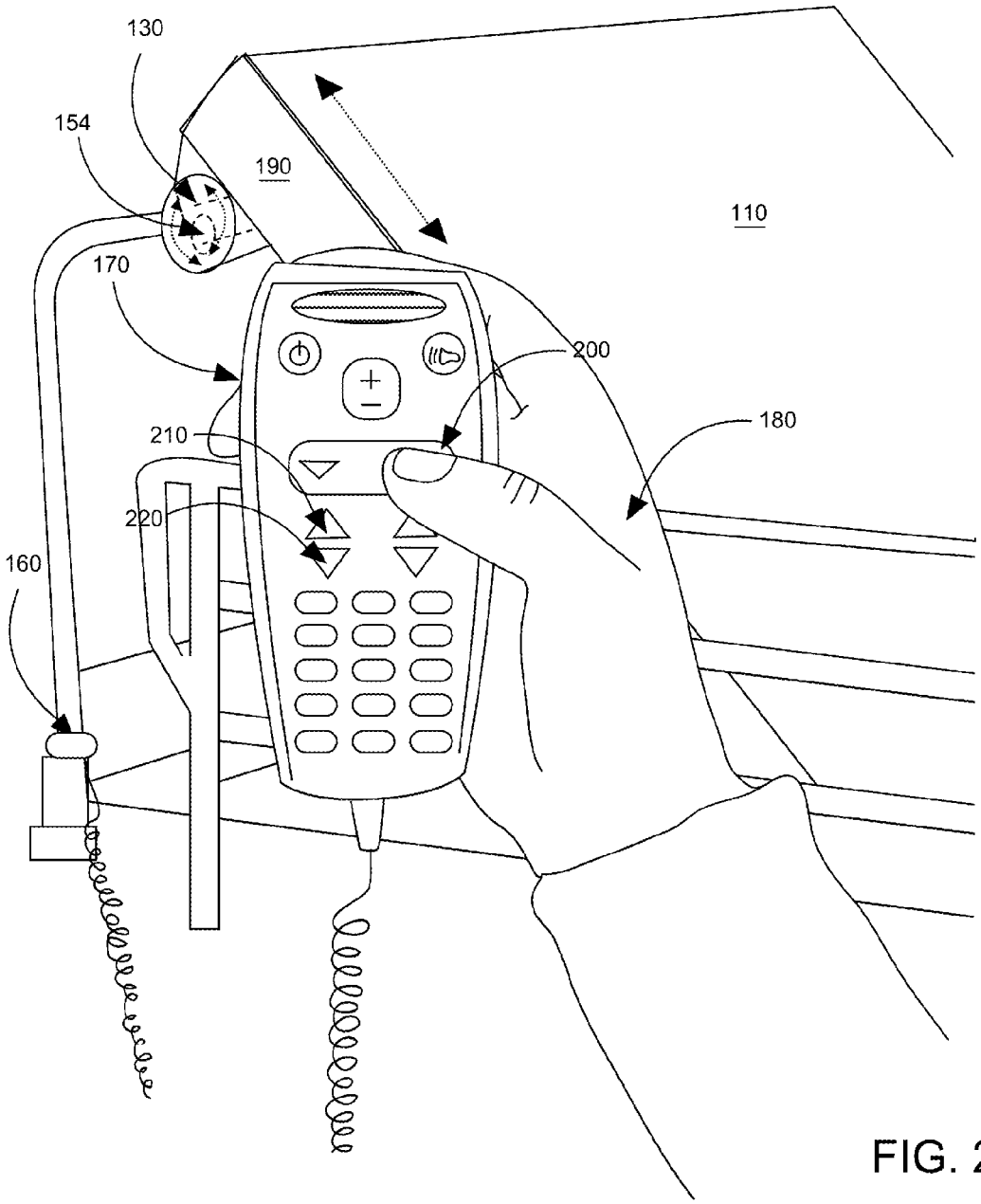
FIG. 2 is a perspective view illustrating a remote as used to manipulate the in-bed patient-positioning and manipulation system according to an embodiment of the present invention of FIG. 1.
Figure 3:
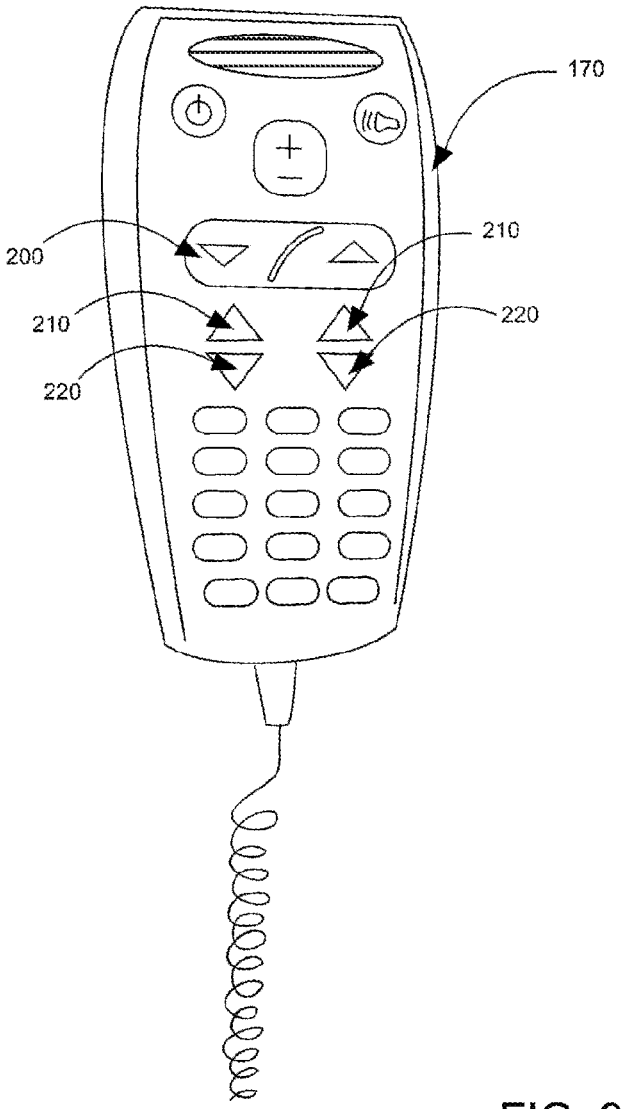
FIG. 3 is another perspective view illustrating the remote of the in-bed patient-positioning and manipulation system according to an embodiment of the present invention of FIGS. 1-3.

Referring now to FIGS. 2 & 3, illustrating remote 170 as used to manipulate in-bed patient-positioning and manipulation system 100 according to an embodiment of the present invention of FIG. 1.

Remote 170 of in-bed patient-positioning and manipulation system 100 preferably comprises rotation speed-controller 200 (acting in the capacity of a reostat.) Further, remote 170 comprises up 210 and down 220 control-buttons. In-bed patient-positioning and manipulation system 100 may be controlled via remote 170 to ensure that the process is virtually effortless for patient 180. Conveyor sheet 110 preferably retracts back once rotation speed-controller 200 on remote 170 is depressed (up-button). Gearing cluster 150 preferably comprises a low speed gear ratio such that conveyor sheet 110 moves in a small incremental rotation (slow motion) thereby preferably preventing patient 180 from sustaining potential injury. Wiring from housing unit 120 may be wired into the other electronic items on remote 170. Other OEM remotes may be retro-fitted to work with the present system; however it is desirable that remote 170 is used.

Figure 4:
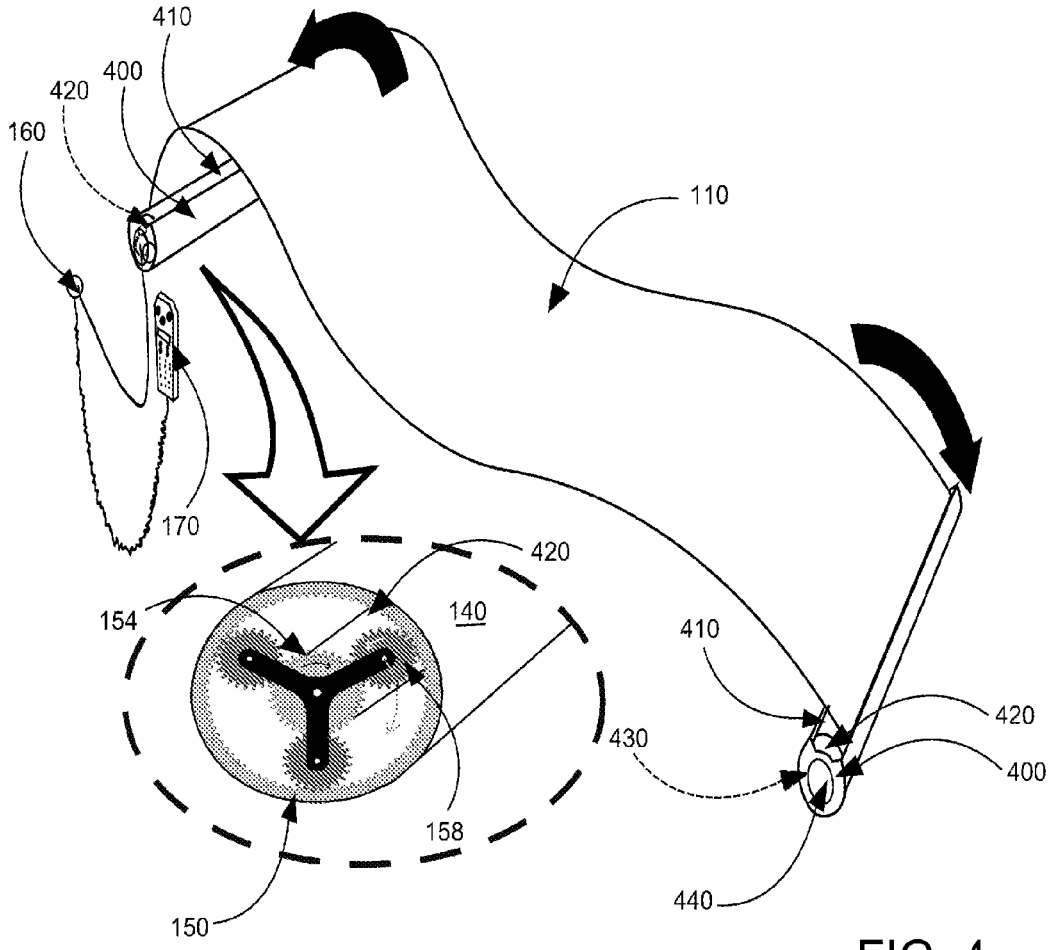
FIG. 4 is a perspective view illustrating an in-bed patient-positioning manipulation assembly according to an embodiment of the present invention of FIG. 1.

Referring now to FIG. 4, illustrating in-bed patient-positioning manipulation assembly 102 according to an embodiment of the present invention of FIG. 1.

Housing unit(s) 120 preferably comprise cylindrical member(s) 400 and bearings 430 such that cylindrical member(s) 400 are supported and carried during rotation on bearings 430. Cylindrical member(s) 400 preferably comprise an upper-opening 410. Upper-opening 410 of cylindrical member(s) 400 preferably permits conveyor sheet 110 to be able to ingress and egress and be rolled about shaft 420. Roller 140 preferably comprises shaft 420. Shaft 420 is preferably located concentrically inside housing unit(s) 120. Shaft 420 is preferably located and supported for rotation on bearings 430 located in cap ends 440 of housing units 120. Further, housing units 120 are preferably cylindrically shaped to accommodate rolled conveyor sheet 110.

As stated previously, gearing cluster(s) 150 are preferably connected to roller(s) 140 such that roller(s) 140 may be rotatably-drive-manipulated. Gearing cluster(s) 150 preferably comprises drive gear 154 and driven gear 158. Drive gear 154 comprises a greater number of teeth than driven gear 158. Driven gear 154 is located on shaft 420. Shaft 420 preferably comprises roller 140. Gearing cluster(s) 150 comprises a low speed gear ratio such that conveyor sheet 110 moves in a small incremental rotation to prevent patient injury. The low speed gear ratio comprises at least a 10 to 1 ratio. In other embodiments the gear ratio may be higher or lower.

In-bed patient-positioning and manipulation system 100 according to an embodiment of the present invention of FIGS. 1-4 may comprise kit 440. Kit 440 may comprise the following parts: in-bed patient-positioning manipulation assembly 102 including conveyor sheet 110; two housing units 120; and remote 170. Additionally, kit 440 may be sold as individual components depending on wholesaler/retailer-preference. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, parts may be sold separately.

Figure 5:
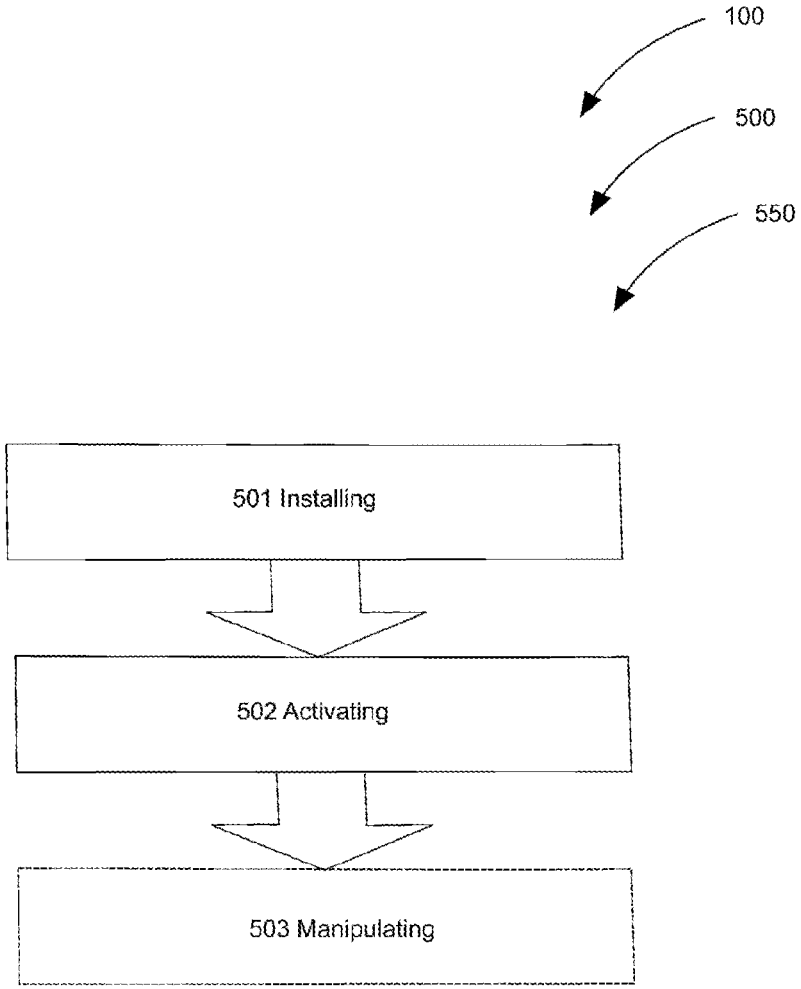
FIG. 5 is a flowchart illustrating a method of use for the in-bed patient-positioning and manipulation system according to an embodiment of the present invention of FIGS. 1-4.

Referring now to FIG. 5, a flowchart illustrating a method of use for in-bed patient-positioning and manipulation system 100 according to an embodiment of the present invention of FIGS. 1-4.

A method of using (at least herein enabling method of use 500) in-bed patient-positioning and manipulation system 100 may comprise the steps of: step one 501 installing in-bed patient-positioning manipulation assembly 102 onto bed 190; step two 502 activating remote 170 to incrementally move conveyor sheet 110 in relation to an upper surface of bed 190 to move patient 180 positioned on conveyor sheet 110; and step three 503 manipulating a rotation speed of conveyor sheet 110. Conveyor sheet 110 is preferably coupled to roller 140 via a rotation speed-controller. Conveyor sheet 110 can be rolled upwardly causing patient 180 to be pulled towards the head of bed 190. Conveyor sheet 110 may also be unrolled causing patient 180 to be pulled towards a foot of bed 190.

It should be noted that step three 503 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An in-bed patient-positioning and manipulation system comprising:

a) an in-bed conveyor sheet;

b) at least one in-bed housing unit having, i) inner volume;

ii) at least one in-bed roller;

iii) at least one in-bed gearing cluster;

c) a power source;

d) a remote;

e) wherein said housing unit comprises a cylindrical member;

f) wherein said cylindrical member comprises an upper-opening;

g) wherein said at least one in-bed gearing cluster is structured and arranged with a drive gear comprising a greater number of teeth than said driven gear;

h) wherein said in-bed conveyor sheet is connected to said in-bed roller;

i) wherein said in-bed roller is housed within said inner volume;

j) wherein said in-bed gearing cluster are connected to said in-bed roller such that said in-bed roller is rotatably-drive-manipulated via said remote, when said remote is activated to sequentially roll said in-bed conveyor sheet upon said in-bed roller;

k) wherein said remote is powered via said power source; and l) wherein said in-bed conveyor sheet is able to be rolled and unrolled to manipulate a relative position of a patient residing in same bed as said in-bed conveyor sheet, said in-bed roller, and said in-bed gearing cluster.

2. The in-bed patient-positioning and manipulation system of claim 1 wherein said housing units are mounted under each end of said bed.

3. The in-bed patient-positioning and manipulation system of claim 2 wherein said bed comprises a hospital-bed.

4. The in-bed patient-positioning and manipulation system of claim 1 wherein said housing unit structured and arranged such that conveyor sheet is able to ingress and egress and be rolled about a shaft via an upper-opening of said housing unit.

5. The in-bed patient-positioning and manipulation system of claim 4 wherein said upper opening of said cylindrical member is structured and arranged such that said in-bed conveyor sheet is able to ingress and egress and be rolled about a shaft.

6. The in-bed patient-positioning and manipulation system of claim 5 wherein said in-bed housing unit further comprises bearings.

7. The in-bed patient-positioning and manipulation system of claim 6 wherein said in-bed gearing cluster comprises a drive gear.

8. The in-bed patient-positioning and manipulation system of claim 7 wherein said in-bed gearing cluster comprises a driven gear.

9. The in-bed patient-positioning and manipulation system of claim 8 wherein said driven gear is located on said shaft.

10. The in-bed patient-positioning and manipulation system of claim 9 wherein said in-bed roller comprises said shaft.

11. The in-bed patient-positioning and manipulation system of claim 10 wherein said in-bed gearing cluster comprises a low speed gear ratio such that said in-bed conveyor sheet moves in a small incremental rotation.

12. The in-bed patient-positioning and manipulation system of claim 11 wherein said low speed gear ratio comprises at least a 10 to 1 ratio.

13. The in-bed patient-positioning and manipulation system of claim 12 wherein said drive gear comprises a greater number of teeth than said a driven gear that is structured and arranged such that said driven gear is located on said shaft wherein said shaft comprises said roller.

14. The in-bed patient-positioning and manipulation system of claim 1 wherein said remote comprises a rotation speed-controller.

15. The in-bed patient-positioning and manipulation system of claim 1 wherein said remote comprises up and down control-buttons.

16. The in-bed patient-positioning and manipulation system of claim 1 wherein said in-bed conveyor sheet comprises a water-resistant fabric.

17. An in-bed patient-positioning and manipulation system comprising:

a) an in-bed conveyor sheet;

b) at least one in-bed housing unit having, i) inner volume;

ii) at least one in-bed roller comprising a shaft;

iii) at least one in-bed gearing cluster including at least one drive gear and at least one driven gear, wherein said drive gear comprises a greater number of teeth than said driven gear;

iv) bearings;

c) a power source; and d) a remote;

e) wherein said housing unit comprises a cylindrical member;

f) wherein said cylindrical member comprises an upper-opening;

g) wherein said at least one in-bed gearing cluster is structured and arranged with a drive gear comprising a greater number of teeth than said driven gear;

h) wherein said housing units are mounted under a head and a foot of a bed;

i) wherein said bed comprises a hospital-bed;

j) wherein said in-bed conveyor sheet is connected to said in-bed roller;

k) wherein said in-bed roller is housed within said inner volume;

l) wherein said housing unit comprise a cylindrical member;

m) wherein said cylindrical member comprises an upper-opening;

n) wherein said in-bed gearing cluster are connected to said in-bed roller such that said in-bed roller is rotatably-drive-manipulated via said remote, when said remote is activated to sequentially roll said in-bed conveyor sheet upon said in-bed roller;

o) wherein said driven gear is located on said shaft;

p) wherein said in-bed gearing cluster comprises a low speed gear ratio such that said in-bed conveyor sheet moves in a small incremental rotation;

q) wherein said low speed gear ratio comprises at least a 10 to 1 ratio;

r) wherein said remote is powered via said power source;

s) wherein said remote comprises a rotation speed-controller;

t) wherein said remote further comprises up and down control-buttons;

u) wherein said in-bed conveyor sheet comprises a water-resistant fabric; and v) wherein said in-bed conveyor sheet is able to be rolled and unrolled to manipulate a relative position of a patient residing in same bed as said in-bed conveyor sheet, said in-bed roller, and said in-bed gearing cluster.

18. The in-bed patient-positioning and manipulation system of claim 17 further comprising a kit wherein said kit comprises an in-bed patient-positioning manipulation assembly including said in-bed conveyor sheet; two said housing units; and said remote.

19. A method of using said in-bed patient-positioning and manipulation system of claim 17 comprising the steps of:

a) installing an in-bed patient-positioning manipulation assembly onto a bed; and b) activating a remote to incrementally move said in-bed conveyor sheet in relation to an upper surface of said bed to move a patient positioned on said in-bed conveyor sheet.

20. The method of claim 19 further comprising the steps of manipulating a rotation speed of said in-bed conveyor sheet, said in-bed conveyor sheet coupled to a said in-bed roller via a rotation speed-controller.

* * * * *